US006579569B2

(12) United States Patent
Bermel et al.

(10) Patent No.: US 6,579,569 B2
(45) Date of Patent: Jun. 17, 2003

(54) SLIDE BEAD COATING WITH A LOW VISCOSITY CARRIER LAYER

(75) Inventors: Marcus S. Bermel, Pittsford, NY (US); Steven P. McKeown, Rochester, NY (US); Kenneth J. Ruschak, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/795,793

(22) Filed: Feb. 28, 2001

(65) Prior Publication Data

US 2002/0160119 A1 Oct. 31, 2002

(51) Int. Cl.[7] ..... B05D 1/30; B05D 1/34
(52) U.S. Cl. ..... 427/402; 427/420
(58) Field of Search ..... 427/402, 420; 118/411, DIG. 4

(56) References Cited

U.S. PATENT DOCUMENTS

| | | | |
|---|---|---|---|
| 2,681,294 A | 6/1954 | Beguin | |
| 2,761,791 A | 9/1956 | Russell | |
| 4,001,024 A | 1/1977 | Dittman et al. | |
| 4,113,903 A | 9/1978 | Choinski | |
| 4,572,849 A | 2/1986 | Koepke et al. | |
| 4,863,765 A | 9/1989 | Ishizuka | |
| 5,861,195 A | 1/1999 | Bhave et al. | 427/402 |

FOREIGN PATENT DOCUMENTS

EP 563 148 B1 * 10/1994

OTHER PUBLICATIONS

Hawley's Condensed Chemical Dictionary, Twelfth Edition, Van Nostrand Reinhold Company, New York, 1993. p. 768.*

* cited by examiner

*Primary Examiner*—Katherine A. Bareford
(74) *Attorney, Agent, or Firm*—Mark G. Bocchetti

(57) ABSTRACT

An improved method of thin film coating is taught that uses a multi-slot coating apparatus to apply multiple liquid layers to a moving substrate. The lowermost layer contacting the substrate is comprised of an organic solvent. The lowermost layer may be a single organic solvent or a blend of several organic solvents. Whether comprised of a single organic solvent or a blend of organic solvents, the viscosity of the lowermost layer is less than 1 cp and the wet thickness of the lowermost layer is not more than about 5 $\mu$m. Additional liquid layers are applied to the moving substrate on the top of the lowermost layer. This method allows for application of coatings at high substrate speeds. This method also allows for the reduction of coating artifacts caused by contamination of the surface of the die.

16 Claims, 1 Drawing Sheet

SLIDE BEAD COATING WITH A LOW VISCOSITY CARRIER LAYER

FIELD OF THE INVENTION

This invention relates generally to methods for coating a moving web and, more particularly, slide bead coating methods, and most particularly to slide bead coating methods for manufacturing photographic film and paper products.

BACKGROUND OF THE INVENTION

Bead coating is well known in the prior art as described, for example, in U.S. Pat. No. 2,761,791 to Russell. Bead coating is used to apply multiple layers of liquid to a moving substrate. In the method typically referred to as slide bead coating, a multilayer composite comprised of superimposed individual liquid layers is delivered to the moving substrate through the use of a coating die. At the end of the coating die, the layers form a continuous liquid bridge or coating bead between the die and the moving substrate. The slide bead coating method is useful for making thin, highly uniform, composite elements suitable for numerous applications, including photographic, thermographic, x-ray, and photoelectric films, among others.

In the practice of slide bead coating, the lowermost layer typically has a wet thickness of approximately 40–100 microns and a viscosity of 3–10 cp. as noted in U.S. Pat. No. 4,001,024 to Dittman. Alternatively, Dittman teaches the use of a lowermost layer having a wet thickness of only 2–12 $\mu$m and a viscosity of 1–8 cp. This thin lowermost layer is known in the art as a carrier layer. Because a carrier layer is thin, dryer load is reduced and operation at high substrate speeds is possible. One drawback to the use of a carrier layer in slide bead coating is the formation of mixing artifacts between the carrier layer and adjacent upper layer as described in Dittman.

Subsequent improvements to the carrier layer method of slide bead coating have also been directed toward dryer efficiency. Some of these improvements describe the use of layers having high viscosity. Because high viscosity layers generally have a higher percentage of solid material, there is less water to be removed during drying. U.S. Pat. No. 4,113,903 to Choinski, for example, teaches the use of a pseudoplastic carrier layer having a high viscosity in the range of 20–200 cp. Although a pseudoplastic carrier layer has a high viscosity at low shear, the liquid obtains substantially lower viscosity at the high shear rates present in the coating bead. Moreover, the use of a high viscosity liquid in the lowermost layer is claimed to overcome the mixing artifacts noted by U.S. Pat. No. 4,001,024 to Dittman, between the carrier layer and adjacent upper layer. However, the practical significance of a pseudoplastic carrier layer is diminished by the fact that special additives may be required to achieve high viscosity and pseudoplastic behavior. Such additives may be expensive or incompatible with the function of the finished film.

Similarly, U.S. Pat. No. 4,572,849 to Koepke, suggests the use of high viscosity fluids in the uppermost layers to reduce dryer load. These high viscosity layers are used in conjunction with the carrier layer described previously by U.S. Pat. No. 4,001,024 to Dittman. As is the case for a high viscosity carrier layer, a high viscosity liquid in the uppermost layers may have a correspondingly high solids concentration. As a result, the time and energy required to remove water during the drying process may be minimized.

U.S. Pat. No. 4,863,765 to Ishizuka, describes a carrier layer of pure water at 40° C. having a wet thickness of less than 2 $\mu$m. Although an ultra thin aqueous carrier layer reduces dryer load, the improvement over U.S. Pat. No. 4,001,024 to Dittman is relatively small. One drawback to the use of water as a carrier layer is that water is incompatible with many organic coating fluids. Incompatible coating fluids create precipitate on the surface of the coating die, and ultimately produce large amounts of waste due to streaks. Another drawback to U.S. Pat. No. 4,863,765 to Ishizuka, is that the carrier layer temperature is high at 40° C. When applying layers with highly volatile organic solvents, high temperatures are undesirable since premature evaporation of solvent causes precipitate or a crust to form on the coating die resulting in streak non-uniformity in the film. Application of layers at high temperatures may also cause undesirable mottle patterns to form as a result of rapid flashing of solvent during drying. Both streak and mottle non-uniformities result in unacceptable levels of waste.

Although the carrier layer methods described above allow for a modest increase in substrate speed by reducing dryer load, substrate speed is ultimately limited by other factors when drying capacity is adequate. For example, the formation of regularly spaced streaks has been noted by U.S. Pat. No. 4,863,765 (Ishizuka) when substrate speeds are high. Other coating artifacts are created as air becomes entrained in the coating bead at very high substrate speeds. These defects are conspicuous at the point of application of the coating to the moving substrate as well as during subsequent visual inspection of dried film samples. Dried samples have numerous small bubbles and localized thickness variations when air is entrained at the coating bead. Defects resulting from entrained air are generally observed with all coating methods including the carrier layer methods described above.

Another coating artifact encountered with the carrier layer method is the formation of streaks caused by deposition of coating materials on the surface of the coating die. Coating materials from an upper layer may be deposited on a slide surface during start-up procedures as well as during coating when the upper slots of the die are serviced to clear bubbles or slugs. Once deposited on the slide surface, these materials typically obstruct the flow of coating fluids on the slide surface for several minutes and produce undesirable streaks in the final film. For the carrier layer method, contamination is especially problematic for the first slide surface which typically has only a thin layer of fluid between the first slide surface and the upper layers. Although the contamination is eventually washed away, in some cases contamination may persist for several minutes. Even at a moderate line speed of 200 cm/s, a single contamination episode of only three minutes would generate 360 linear meters of streak waste.

U.S. Pat. No. 5,861,195 to Bhave describes contamination of the surfaces of a coating die caused by the application of layers having incompatible materials. In particular, when a polymer in the lowermost layer is not compatible with a polymer in the uppermost layers, undesirable contamination of the slide surface may produce streak waste. This particular slide contamination results from the precipitation of incompatible polymers and is called strikethrough. U.S. Pat. No. 5,861,195 to Bhave teaches the use of a slightly higher density fluid as a carrier layer to minimize contamination episodes. Examples describe the addition of polymer to the lowermost layer to increase density. Another more elaborate remedy involves separating the lowermost layer from the incompatible materials of the uppermost layers by a second layer having both a higher density than the uppermost layers and a polymer compatible with the lowermost layer. However, adjustment of fluid density requires the use of additional materials which may be expensive or harmful to the performance of the final product. Moreover, the use of additional layers to protect the lowermost carrier layer is complicated and may have undesirable effects on drying efficiency as well as on product performance.

SUMMARY OF THE INVENTION

It is therefore an object of the present invention to overcome limitations inherent to slide bead methods when applying organic coatings at high substrate speeds.

It is a further object of the present invention to minimize streak artifacts created by contamination of the surface of the coating die.

Yet another object of the present invention is to provide a slide bead coating method which reduces the duration of slide contamination and streak formation.

Briefly stated, the foregoing and numerous other features, objects and advantages of the present invention will become readily apparent upon a review of the detailed description, claims and drawings set forth herein. These features, objects and advantages are accomplished by forming a multilayer composite on a slide surface of a coating hopper, the multilayer composite including a carrier layer that is an organic solvent or blend of organic solvents that are substantially free of other constituents, the carrier layer having a viscosity of less than 1 cp and a wet thickness of not more than 5 $\mu$m; flowing the multilayer composite down the slide surface and over a coating lip of the coating hopper; and forming a coating bead between the coating lip and the web. In the practice of the method of the present invention it is preferred that the web be travelling at a speed of at least about 50 cm/sec. These conditions are readily attained at the temperatures routinely used to prepare films with highly volatile organic liquids. In particular, the use of the method of the present invention is shown to substantially extend substrate speed by elimination of defects caused by entrained air in the coating bead. Moreover, the use of an organic solvent or an organic solvent blend is found to overcome streak artifacts created when aqueous liquids are used as carrier layers in conjunction with layers containing organic solvents. The present invention also overcomes undesirable mixing artifacts between the lowermost and upper layers since the carrier layer is only a vehicle and is not part of the finished film. In addition, the use of the method of the present invention can be employed to substantially minimize the duration of slide contamination and streak formation through the selection of an appropriate organic solvent or blend of organic solvents as a carrier layer. Therefore, the present invention provides an advantageous method for the fabrication of thin, uniform films such as required for photographic elements or other similar elements.

In the practice of the method of the present invention, one or more of the upper layers preferably has a viscosity that is greater than the viscosity of the carrier layer. When the carrier layer is formed of a blend of organic solvents, preferably at least two of the following components: methanol, ethanol, isopropanol, n-propanol, n-butanol, acetone, methylethyl ketone, methylisobutyl ketone, toluene and methylene chloride are contained in the blend. It is also preferred that the layers above the carrier layer contain at least one of the following polymeric materials: cellulosics, polyvinylbutyrals, polyurethanes, polycarbonates and polyesters. Further in the practice of the method of the present invention it is preferred that the layers above the carrier layer have a combined wet thickness in the range of range of 1–500 $\mu$m and at least one of such upper layers has a viscosity in the range of 100–5,000 cp. In addition, one or more of such upper layers may include water.

Although the present invention is discussed herein with particular reference to a slide bead coating operation, those skilled in the art will understand that the present invention can be advantageously practiced with other multilayer coating operations. For example, high substrate speeds should be achievable with multilayer extrusion hopper coating operations and multilayer curtain coating operations. Practical applications of the present invention include photographic, thermographic and x-ray films as well as photographic, thermographic and ink jet papers among others.

DETAILED DESCRIPTION OF THE INVENTION

Figure 1:
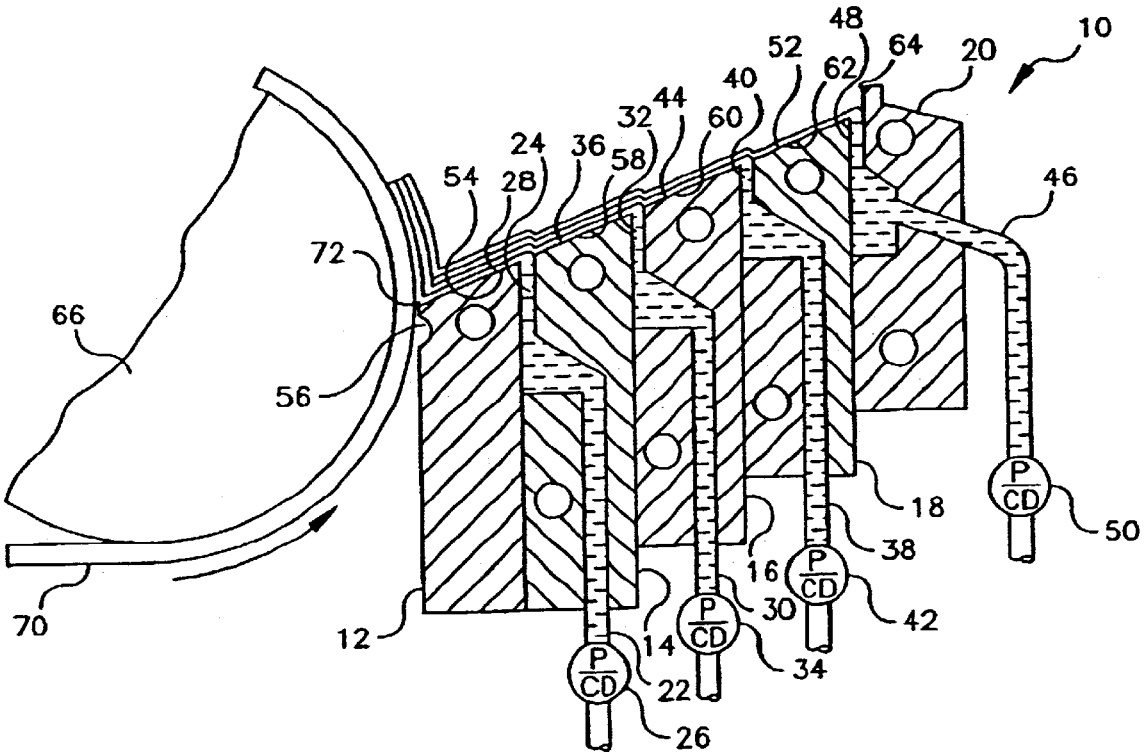
FIG. 1 is a schematic of an exemplary multi-slot slide bead coating apparatus which may be used in the practice of the method of the present invention.

Turning to FIG. 1, there is shown a schematic of an exemplary and well known multi-slot slide bead coating apparatus 10 suitable for practicing the method of the present invention. The multi-slot slide bead coating apparatus 10 is typically used to deliver and coat multiple coating compositions simultaneously as a stacked composite of layers. Coating hopper 10 is shown as having only four slots, but multiple slot hoppers 10 may have fewer than four slots and are also known to deliver a composite layer comprised of five or six (or even more) coating composition layers.

Coating hopper 10, shown in side elevational cross-section, includes a front section 12, a second section 14, a third section 16, a fourth section 18, and a back plate 20. There is an inlet 22 into second section 14 for supplying coating liquid to first metering slot 24 via pump 26 to thereby form a lowermost layer or carrier layer 28. There is an inlet 30 into third section 16 for supplying coating liquid to second metering slot 32 via pump 34 to form layer 36. There is an inlet 38 into fourth section 18 for supplying coating liquid third metering slot 40 via pump 42 to form layer 44. There is an inlet 46 into back plate 20 for supplying coating liquid to fourth metering slot 48 via pump 50 to form layer 52. Each slot 24, 32, 40, 48 includes a transverse distribution cavity. Front section 12 includes an inclined slide surface 54, and a coating lip 56. There is a second inclined slide surface 58 at the top of second section 14. There is a third inclined slide surface 60 at the top of third section 16. There is a fourth inclined slide surface 62 at the top of fourth section 18. Back plate 20 extends above inclined slide surface 62 to form a back land surface 64.

Residing adjacent the hopper 10 is a coating backing roller 66 about which a web 70 is conveyed. Typically, the hopper 10 is movable from a non-coating position toward the coating backing roller 66 and into a coating position.

In the practice of the method of the present invention, the lowermost or carrier layer 28 is an organic solvent or blend of organic solvents that is substantially free of other constituents. The term "substantially free of other constituents" as used herein is intended to mean that the organic solvent or blend of organic solvents have a purity level of at least about 98% and that any contaminants or additives present do not affect the viscosity of the carrier layer 28. This lowermost layer or carrier layer 28 which is metered through the first metering slot 24, moves down the first slide surface 54, and wets the moving web 70 at the point where the coating bead 72 contacts the web 70. In a preferred embodiment of the present invention, the lowermost layer 28 is an organic solvent or blend of organic solvents having a viscosity of less than 1 cp., a surface tension of less than 40 dynes/cm, and a wet thickness range of from about 2 to about 5 $\mu$m on the moving web 70.

As mentioned above, the lowermost layer 28 may be comprised of single organic solvent. Examples of suitable organic solvents at 20° C. include methanol (0.6 cp.), acetone (0.3 cp.), methylethyl ketone (0.4 cp.), methyl isobutyl ketone (0.6 cp.), methylene chloride (0.4 cp.), toluene (0.6 cp.), methyl acetate (0.4 cp.), ethyl acetate (0.5 cp.), isopropyl acetate (0.5 cp.), and n-propyl acetate (0.6 cp.).

Alternatively, the lowermost layer 28 may be comprised of a combination of two or more organic solvents. Examples of suitable organic solvent blends at 20° C. include 1:1 methanol:methylene chloride (0.6 cp.), 1:1 acetone:methanol (0.4 cp.), and 1:1:1 acetone:methanol:methylene chloride (0.5 cp.). For these examples, solvent ratios are by weight.

In addition, higher viscosity organic solvents, such as ethanol (1.2 cp.), n-propanol (2.3 cp.) and n-butanol (3.0 cp.), may be blended with low viscosity organic solvents to a create lowermost layer 28 having a composite viscosity which is low. Examples of suitable organic solvent blends containing high viscosity organic solvents at 20° C. include 1:1 acetone:n-propanol (0.6 cp.), 1:1 acetone:ethanol (0.5 cp.), 1:1 methanol:ethanol (0.7 cp.), 1:1 methylene chloride:ethanol (0.8 cp.), 1:1:1 acetone:methylene chloride:ethanol (0.5 cp.), 1:1:1 methanol:methylene chloride:n-butanol (0.8 cp.), 1:1:1 acetone:ethanol: n-butanol (0.8 cp.), 1:1:1 methanol:methylene chloride:ethanol (0.8 cp.), and 1:1:1:1 acetone:methanol:methylene chloride:n-propanol (0.6 cp.). For these examples, solvent ratios are by weight.

The second liquid layer 36 which is metered through a second metering slot 32, moves down the second slide surface 58, and is accelerated by the carrier layer 28 down the first slide surface 54 to the coating bead 72. The second layer 36 must be miscible with lowermost layer 28 and is therefore preferably organic, but may contain water. As noted by layers 44, 52 in FIG. 1, additional upper layers may also be applied using the slide bead coating apparatus 10. These additional upper layers may be of a distinct composition relative to the second layer 36 or of the same composition. Similarly, the number of upper layers may also be further increased beyond three by extension of the number of die slots (not shown explicitly in FIG. 1). In a preferred embodiment of the present invention, the upper layers have a combined wet thickness of in the range of from about 1 to about 500 $\mu$m, and at least one of the upper layers has a viscosity greater than 100 cp.

Because the method of the present invention may involve application of highly volatile organic solvents, the temperature at which coating is performed is preferably less than or equal to 25° C. to avoid non-uniformities due to streaks and mottle. Methylene chloride, acetone, methyl acetate and methanol are examples of highly volatile organic solvents having a vapor pressure above 100 mm Hg at 25° C.

The method of the present invention is suitable for application of multilayer coatings to a variety of substrates such as polyethylene terephthalate (PET), cellulose acetate, polycarbonate, polystyrene, and other polymeric films. Additional substrates may include paper, laminates of paper and polymeric films, glass, cloth, aluminum and other metal supports. In some cases, substrates may be pretreated with subbing layers or electrical discharge devices. Substrates may also be pretreated with functional layers containing various binders and addenda.

The advantages of the present invention are demonstrated by the following practical examples given below.

COMPARATIVE EXAMPLE 1

The apparatus 10 illustrated in FIG. 1 was used to apply three organic layers to a moving web 70 of untreated polyethylene terephthalate (PET). All coating fluids were comprised of a polyvinylburyral (hydroxyl content of 18%) dissolved in methanol. The lowermost layer 28 has a viscosity of 2.0 cp. and a wet thickness of 3 $\mu$m on the moving web 70. The second and third layers each had a viscosity of 600 cp. and a combined final wet thickness of 30 $\mu$m on the moving web 70. Coatings were applied at a temperature of 23.9° C. The gap between the coating lip 56 and the moving web 70 was 200 $\mu$m. The pressure differential across the coating bead 72 was adjusted between 0–10 cm of water to establish a uniform coating. The coating quality deteriorated at substrate speeds of 380 cm/s due to defects resulting from entrained air regardless of the applied pressure differential. Unacceptable levels of defects were present at all speeds above 380 cm/s.

COMPARATIVE EXAMPLE 2

The conditions were identical to those described in Comparative Example 1, except that the viscosity of the lowermost layer 28 was increased to 25 cp. Wet thickness was maintained at 3 $\mu$m on the moving substrate. The lowermost layer 28 was pseudoplastic. Specifically, the viscosity of the lowermost layer 28 was 25 cp. at a shear rate of 100 $sec^{-1}$ and below 10 cp. at a shear rate of 100,000 $sec^{-1}$. The coating quality deteriorated at substrate speeds of 250 cm/s due to defects resulting from entrained air regardless of the applied pressure differential. Unacceptable levels of defects were present at all speeds above 250 cm/s.

COMPARATIVE EXAMPLE 3

The conditions for Comparative Example 3 were identical to those described in Comparative Example 1, except that the lowermost layer 28 was replaced by water at a wet thickness of 3 $\mu$m on the moving substrate. Regardless of substrate speed, the coating quality was unacceptable due to streaks caused by precipitation of polymer on the surface of the first slide and hopper lip.

COMPARATIVE EXAMPLE 4

The conditions for Comparative Example 4 were identical to those described in Comparative Example 1, except that the polymer is changed to a less polar polyvinylbutyral (hydroxyl content of 12%). The solvent system for all layers was a blend of 1:1 methanol:ethanol. The solute was compatible among all layers. The lowermost layer 28 had a viscosity of 5 cp. For these experiments, the first slide surface 54 was deliberately contaminated by obstructing a portion (1 cm length) of the exit slot of the lowermost layer 28 for a period of ten seconds. This exercise simulated the act of cleaning the die slots during a coating operation. As a result of the obstruction, the higher viscosity upper layers contaminated the first slide surface 54, and a streak non-uniformity was formed in the coated layers. After the obstruction was removed, the time required for the lowermost layer 28 to completely displace the contamination on the first slide surface 54 and heal the streak non-uniformity was recorded. A dye placed in the lowermost layer 28 aided visualization of the slide contamination and the corresponding streak. The substrate speed was 200 cm/s. The time required to clean the contamination from the first slide surface was 3.6 minutes.

EXAMPLE 1

The conditions for Example 1 were identical to those described in Comparative Example 1, except that the lowermost layer 28 was replaced by methanol having a viscosity of 0.6 cp. and a wet thickness of 3 $\mu$m on the moving web 70. Coating quality was good at substrate speeds to 560 cm/s without defects resulting from entrained air or streaks when the pressure differential across the coating bead 72 was adjusted in the range of 0–10 cm of water.

EXAMPLE 2

The conditions for Example 2 were identical to those described in Comparative Example 1, except that the lowermost layer 28 was replaced by a blend of organic solvents. Specifically, the lowermost layer 28 was 1:1 by weight methanol:ethanol at a viscosity of 0.7 cp. and had a wet thickness of 3 $\mu$m on the moving substrate 70. In addition, the solvent in the upper layers was replaced by 1:1 methanol:ethanol, and the polymer was replaced by a slightly less polar polymer, polyvinylbutyral (hydroxyl content of 12%). The coating quality was good at substrate speeds of 100, 200 and 300 cm/s without defects resulting from entrained air or streaks.

EXAMPLE 3

The conditions for Example 3 were identical to those described in Comparative Example 4, except that the lowermost layer 28 was replaced by a variety of organic solvents as noted in Table 1. The wet thickness of the lowermost layer 28 was maintained at 3 $\mu$m on the moving web 70. The first slide surface 54 was contaminated in the same manner as described earlier in Comparative Example 4, and the time required for the lowermost layer to completely displace the contamination on the first slide surface 54 and heal the streak non-uniformity was recorded. TABLE 1 summarizes the results. As shown in TABLE 1, several organic solvents or blends of organic solvent were found to be more effective at removing the contamination when compared to the prior art. For example, methanol, acetone, methylethyl ketone, and methylene chloride eliminate the contamination in less than 2 minutes. TABLE 1 also indicates that some blends of organic solvents are more effective at removing surface contamination when compared to the prior art.

TABLE 1

Multilayer coatings are delivered to a moving substrate using the die illustrated in FIG. 1. The time required for the first slide surface to self-clean (Heal Time) is given for various carrier layers. Results are for conditions described in Comparative Example 4 and Example 3.

| | Carrier Layer Properties | | | Heal |
|---|---|---|---|---|
| Carrier Layer | Viscosity | Solubility | Density | Time |
| Alcohols | | | | |
| Methanol | 0.6 cps | Swells | 0.79 g/cc | 1.4 min |
| 1:1 Methanol:Ethanol | 0.8 | Soluble | 0.79 | 2.7 |
| Ethanol | 1.2 | Soluble | 0.80 | 4.4 |
| n-butanol | 3.0 | Soluble | 0.81 | 6.0 |
| Ketones | | | | |
| Acetone | 0.3 | Soluble | 0.79 | 0.8 |
| Methylethyl ketone | 0.4 | Soluble | 0.80 | 0.7 |
| Others | | | | |
| Methylene chloride | 0.4 | Soluble | 1.33 | 0.5 |
| 1:1 Methylene chloride:acetone | 0.4 | Soluble | 0.98 | 0.7 |
| 1:1 Methylene chloride:ethanol | 0.8 | Soluble | 0.98 | 1.0 |
| 1:3 Methylene chloride:ethanol | 1.0 | Soluble | 0.88 | 1.7 |
| Prior Art | | | | |
| Polyvinylbutyral in 1:1 methanol:ethanol | 5.0 | Soluble | 0.80 | 3.6 |

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

PARTS LIST

| | |
|---|---|
| 10 | multi-slot slide bead coating apparatus/hopper |
| 12 | front section |
| 14 | second section |
| 16 | third section |
| 18 | fourth section |
| 20 | back plate |
| 22 | inlet |
| 24 | first metering slot |
| 26 | pump |
| 28 | carrier layer |
| 30 | inlet |
| 32 | second metering slot |
| 34 | pump |
| 36 | layer |
| 38 | inlet |
| 40 | third metering slot |
| 42 | pump |
| 44 | layer |
| 46 | inlet |
| 48 | fourth metering slot |
| 50 | pump |
| 52 | layer |
| 54 | first inclined slide surface |
| 56 | coating lip |
| 58 | second inclined slide surface |
| 60 | third inclined slide surface |
| 62 | fourth inclined slide surface |

-continued

| | |
|---|---|
| 64 | back land surface |
| 66 | coating backing roller |
| 70 | moving web |
| 72 | coating bead |

What is claimed is:

1. A slide bead coating process for coating a moving web comprising the steps of:

(a) forming a multilayer composite with a coating hopper, the multilayer composite including a carrier layer that is an organic solvent or a blend of organic solvents substantially free of other constituents, the carrier layer being a lowermost layer of the multilayer composite, the carrier layer having a viscosity of less than 1 cp and a thickness of less than 5 $\mu$m;

(b) applying the multilayer composite on the moving web; and (c) moving the web at a speed of at least about 100 cm/sec.

2. A slide bead coating process as recited in claim 1 wherein:

at least one layer of the multilayer composite above the carrier layer has a viscosity greater than 100 cp.

3. A slide bead coating process as recited in claim 1 wherein:

the carrier layer is a single organic solvent.

4. A slide bead coating process as recited in claim 1 wherein:

the blend of organic solvents contains at least two of the following components: methanol, ethanol, isopropanol, n-propanol, n-butanol, acetone, methylethyl ketone, methylisobutyl ketone, toluene and methylene chloride.

5. A slide bead coating process as recited in claim 1 wherein:

the layers of the multilayer composite above the carrier layer contain at least one of the following polymeric materials: cellulosics, polyvinylbutyrals, polycarbonates, polyurethanes and polyesters.

6. A slide bead coating process as recited in claim 1 wherein:

the layers of the multilayer composite above the carrier layer have a combined wet thickness in a range of 1–500 $\mu$m.

7. A slide bead coating process as recited in claim 1 wherein:

at least one layer of the multilayer composite above the carrier layer has a viscosity in the range of 100–5,000 cp.

8. A slide bead coating process as recited in claim 1 wherein:

at least one layer of the multilayer composite above the carrier layer includes water.

9. A slide bead coating process as recited in claim 1 wherein:

the moving web is untreated polyethylene terephthalate.

10. A slide bead coating process as recited in claim 1 wherein:

the moving web has a subbing layer formed thereon prior to the slide bead coating process.

11. A slide bead coating process as recited in claim 1 wherein:

the carrier layer has a surface tension of less than 40 dynes/cm.

12. A slide bead coating process as recited in claim 1 wherein:

the web is moved at a speed of at least about 200 cm/sec.

13. A slide bead coating process as recited in claim 1 wherein:

the forming step is performed at a temperature of not more than about 25° C.

14. A slide bead coating process for coating a moving web comprising the steps of:

(a) forming a multilayer composite on a slide surface of a coating hopper, the multilayer composite including a carrier layer that is an organic solvent substantially free of other constituents, the carrier layer being a lowermost layer of the multilayer composite, the carrier layer having a viscosity of less than 1 cp and a thickness of less than 5 $\mu$m;

(b) flowing the multilayer composite down the slide surface and over a coating lip of the coating hopper;

(c) forming a coating bead between the coating lip and the moving web with the multilayer composite; and (d) moving the web at a speed of at least about 100 cm/sec.

15. A slide bead coating process as recited in claim 14 wherein:

the web is moved at a speed of at least about 200 cm/sec.

16. A slide bead coating process as recited in claim 14 wherein:

the forming step is performed at a temperature of not more than about 25° C.

* * * * *